United States Patent [19]

Asick et al.

[11] Patent Number: 4,550,960

[45] Date of Patent: Nov. 5, 1985

[54] SHIELDED BACKPLANE ASSEMBLY

[75] Inventors: John C. Asick, Harrisburg; George H. Douty, Mifflintown; John M. Landis, Camp Hill; Clair W. Snyder, Jr., York; James S. Staron, Dillsburg, all of Pa.

[73] Assignee: AMP Incorporated, Harrisburg, Pa.

[21] Appl. No.: 643,942

[22] Filed: Aug. 24, 1984

[51] Int. Cl.[4] ..... H01R 13/648

[52] U.S. Cl. ..... 339/14 R; 339/17 C; 339/143 R

[58] Field of Search ..... 339/14 R, 17 C, 143 R, 339/36, 31 R, 31 M, 32 R, 32 M; 29/825

[56] References Cited

U.S. PATENT DOCUMENTS

| | | | |
|---|---|---|---|
| 3,922,056 | 11/1975 | Murawski et al. | 339/143 R |
| 3,966,290 | 6/1976 | Little et al. | 339/17 LC |
| 4,053,199 | 10/1977 | Hollyday et al. | 339/17 C |
| 4,227,238 | 10/1980 | Saito | 339/17 C |
| 4,386,814 | 6/1983 | Asick | 339/14 R |
| 4,451,107 | 5/1984 | Dola et al. | 339/14 R |

FOREIGN PATENT DOCUMENTS

| | | | |
|---|---|---|---|
| 4422 | 3/1979 | European Pat. Off. | 339/17 C |

*Primary Examiner*—John McQuade

*Attorney, Agent, or Firm*—Russell J. Egan; F. Brice Faller

[57] ABSTRACT

A shielded backplane assembly is formed by a plurality of pairs of first and second shrouds, each pair enclosing an array of pin terminals from opposite sides of the backplane. A profiled ground plane, which engages a chassis cover, profiles entry to the second shroud to make wiping contact with a shielded connector received therein. The assembly also includes covers for enclosing the unused portions of each pin array.

6 Claims, 6 Drawing Figures

SHIELDED BACKPLANE ASSEMBLY

The present invention relates to a backplane connector assembly and, in particular, to one which is totally shielded and in which all pins can be utilized.

The recent increased requirements for RF/EMI shielding have caused a number of problems in the electronics industry. These problems are generally of a design nature centering about the requirements for RF/EMI shielding and the necessary space taken up by such shielding. This all relates to the problem of space and the current trend towards high density interconnect arrangements. The addition of shielding must not interfere with the number of possible interconnects at a single location and yet it must provide for shielding in alternate interconnect configurations.

The present invention overcomes the difficulties of the prior art by providing a backplane assembly which provides total RF/EMI shielding. The backplane is provided with a plurality of high density pin arrays, each mating with a respective circuit board assembly on one side and having a shroud enclosing each pin array on the opposite side of the backplane. Each shroud includes a ground plane spring or gasket about the periphery thereof engaging a chassis panel. The chassis panel is provided with a plurality of retention bars which serve to hold shielded connectors within the shroud as well as cover plates overlying unoccupied portions of the shrouds.

The present invention will be described by way of example with reference to the accompanying drawings in which.

Figure 1:
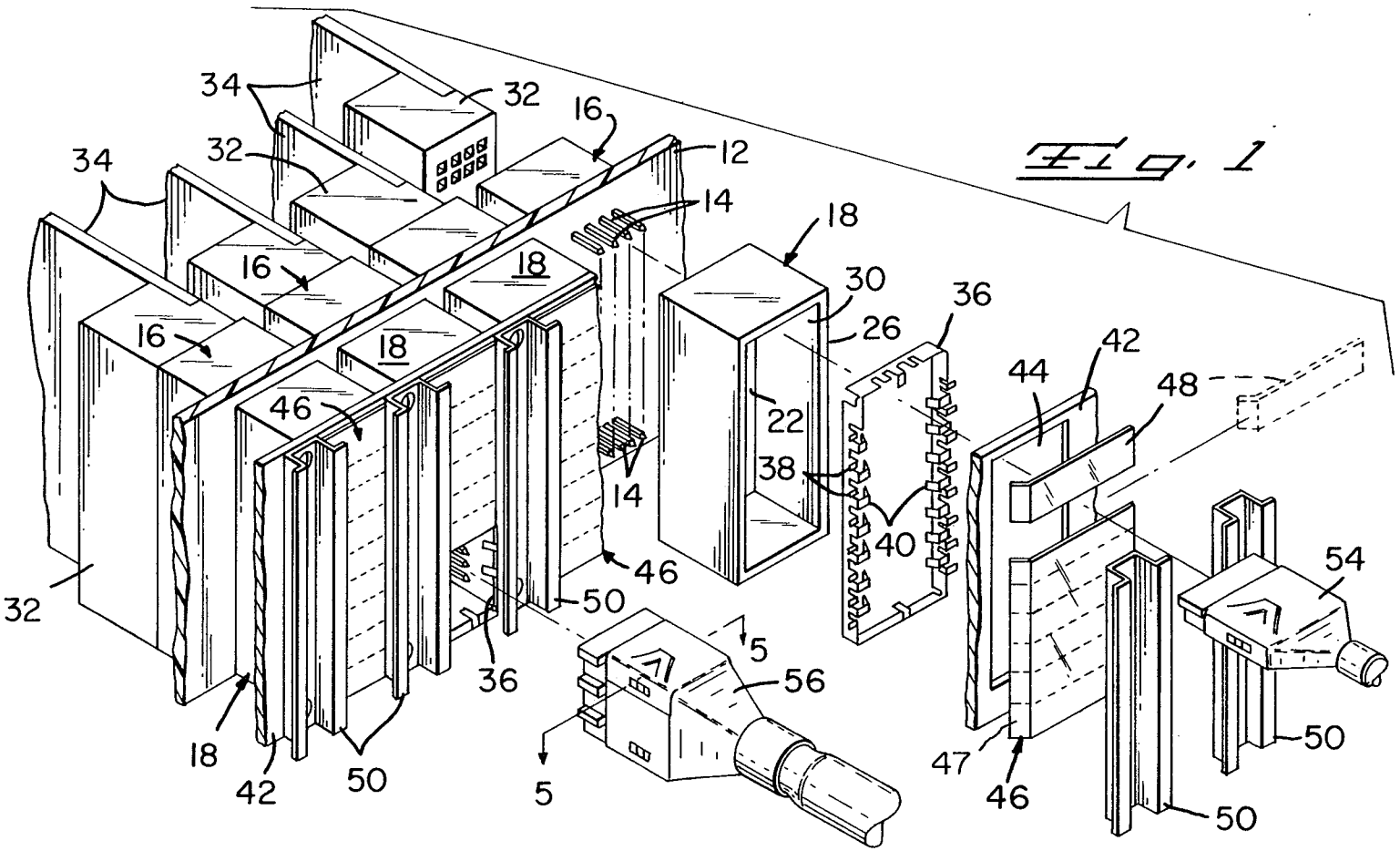
FIG. 1 is a perspective view, partially in section and partially exploded, showing a shielded backplane assembly according to the present invention.

The subject shielded backplane assembly 10 is formed by a backplane 12 having a plurality of arrays of pin terminals 14 extending therethrough and enclosed on opposite sides by first and second shrouds 16, 18. Each shroud 16, 18 is a generally rectangular member of insulative material having a base 20, 22 surrounded by integral continuous sidewall 24, 26, defining a cavity 28, 30 (see FIG. 3), through which the pin terminals 14 project. The first shroud 16 is profiled to receive therein a connector 32 mounted on the edge of a circuit board 34. The first shroud 16 and connector 32 may be of any well-known configuration, such as that shown in U.S. Pat. No. 3,966,290, the disclosure of which is incorporated herein by reference.

A metal ground plane spring or gasket 36 is fitted on the open side of the second shroud 18. The ground plane 36 is a generally rectangular metal member having a plurality of first tabs 38 extending outward from to the adjacent sidewall 26 of the second shroud 18 and a plurality of second tabs 40 which are wrapped over the adjacent sidewall 26 and depend to a point within the cavity 30.

Figure 2:
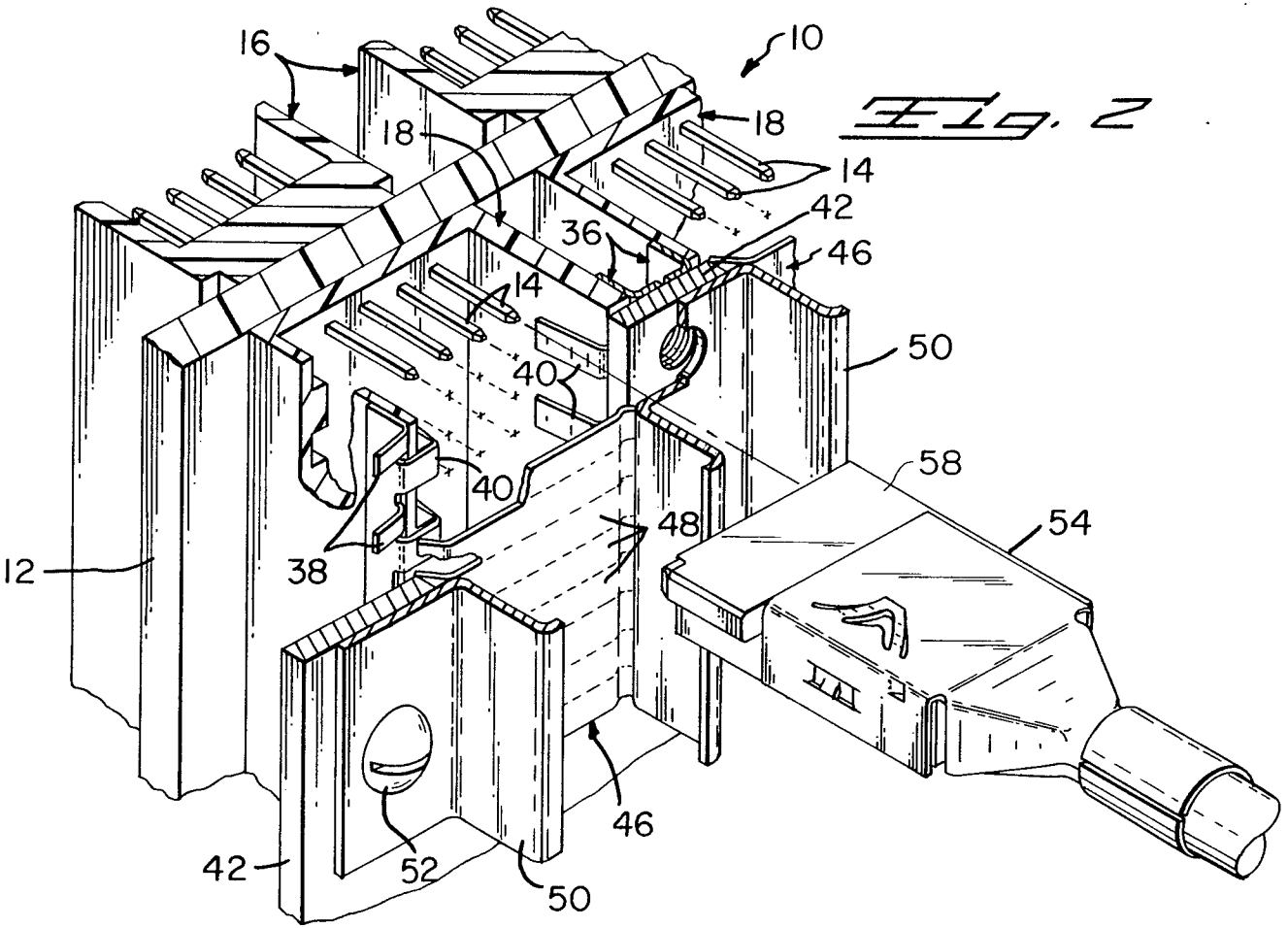
FIG. 2 is a perspective view, partially in section, of a portion of the subject shielded backplane assembly.
Figure 3:
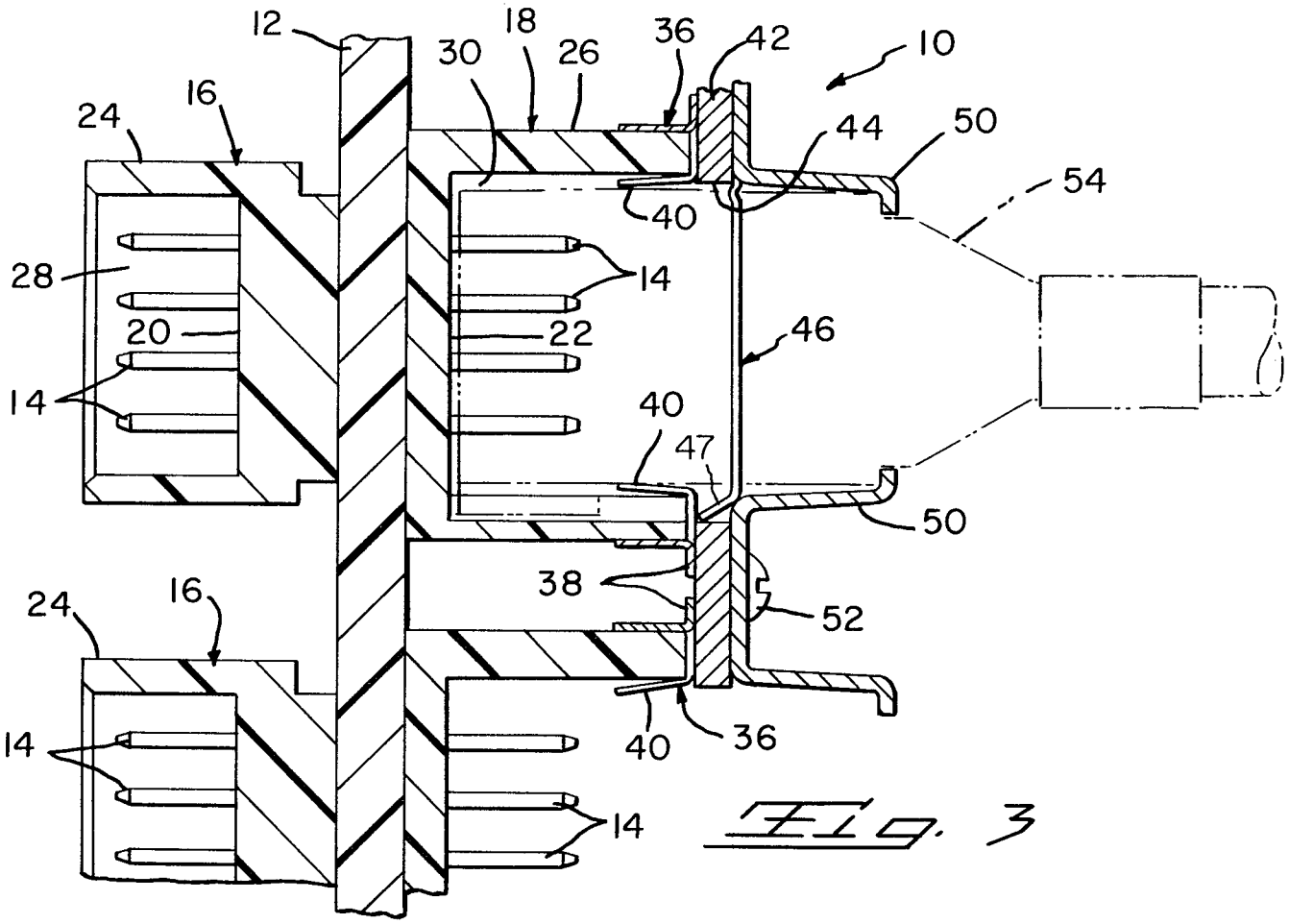
FIG. 3 is a transverse section through a portion of the subject shielded backplane assembly.

The backplane 12, second shroud 18, and ground plane 36 are enclosed within a chassis panel 42 which has a plurality of apertures 44, each aligned with the cavity 30 of a respective second shroud 18. A conductive cover assembly 46 having contact means in the form of flange 47 and comprised of a number of breakaway sections 48 is used to cover each of the apertures 44. Only the sections 48 over the portion of the pin array to be engaged are removed. The cover assembly 46 is secured in place by retention bars 50 which are fastened to the chassis panel 42 by known fastening means 52 (see FIG. 2). Referring to FIG. 3, the flange 47 extends through aperture 44 to contact gasket 46. The bars 50 also serve to retain connectors 54, 56.

A number of shielded connectors 54, 56 can be used to mate with respect portions of the arrays of pin terminals 14. The details of the connectors 54, 56 can best be appreciated from FIGS. 4 and 5. It will be noted that the connectors 54, 56 are basically the same with the connector 56 being a triple version of the connector 54. Each connector 54, 56 contains at least one profiled connector housing 58 of insulative material having a mating face 60 profiled by a pair of outwardly directed flanges 62, 64 at the opposite ends thereof. The housing 58 is profiled between the mating face 60 and the rear portion 66 for any suitable connector-terminal configuration. In this instance, the housing 58 has been shown with a double row of open channels 68 capable of receiving therein a mass terminable, insulation displacing terminal 70 of the type shown in FIG. 6. Details on a suitable housing profile can be found in U.S. Pat. No. 4,243,288, and details of a suitable terminal can be found in U.S. Pat. No. 4,385,794, the disclosures of both being incorporated herein by reference.

Figure 4:
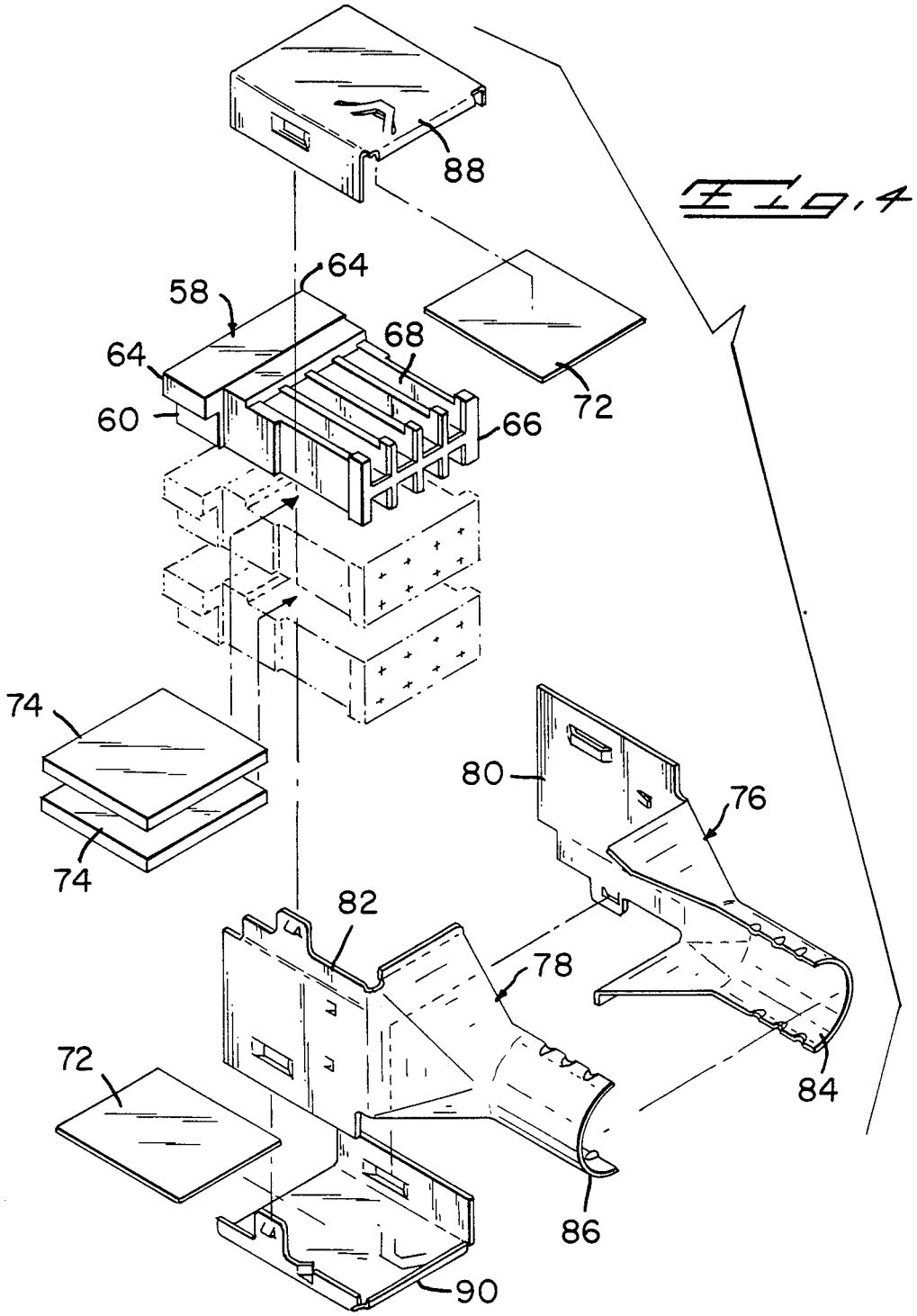
FIG. 4 is an exploded perspective view of one of the mating plug connectors for use in the present invention.
Figure 5:
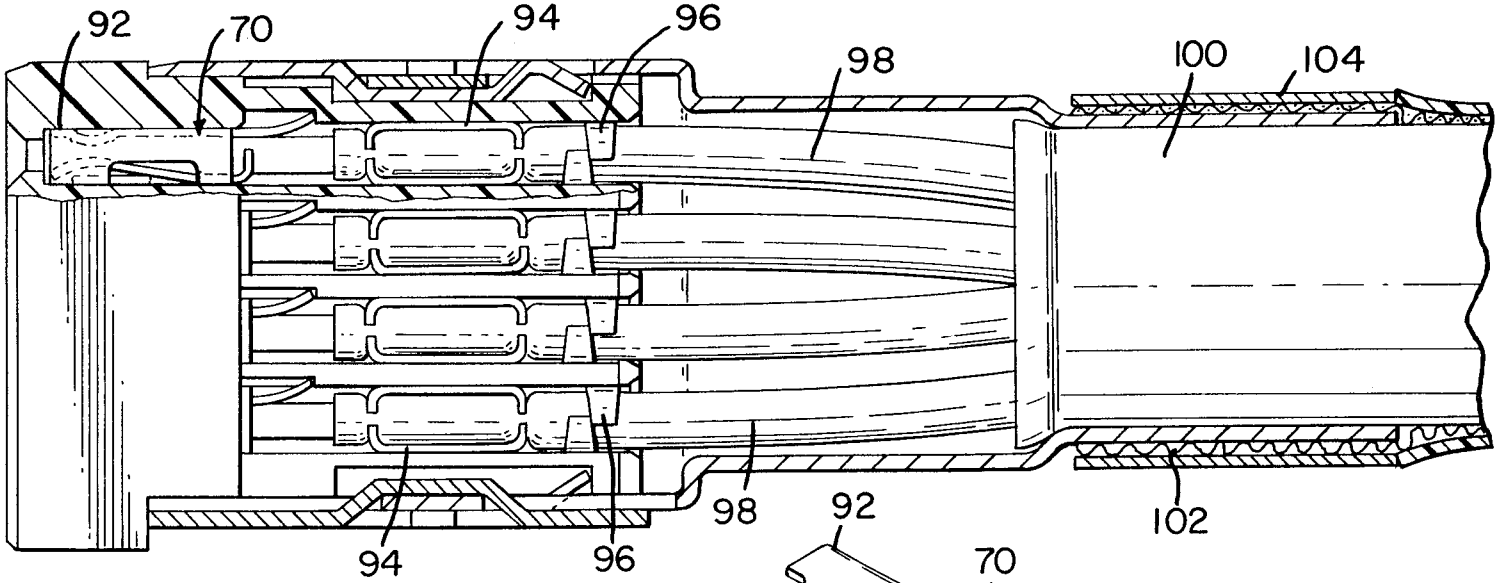
FIG. 5 is a longitudinal section through a portion of the connector of FIG. 4.

In the multiconnector configuration shown in FIG. 4, the connector 56 includes a series of housing 58 with an insulating layer 72 on the outside and insulating spacers 74 between adjacent housings 58. The subassembly of housings 58, insulating layers 72 and spacers 74 is enclosed within a metal shell formed by a pair of identical metal side shell members 76, 78 defining sidewalls 80, 82 tapering to a cable entry 84, 86, a top cover 88 and a bottom cover 90 which join with the side shell members 76, 78 to entirely enclose the above-mentioned subassembly leaving only the forward profiled ends of the housings 58 exposed. It will be appreciated from FIG. 4 that the side shell members 76, 78 can be varied in dimension to accommodate most any convenient number of connector housings 58. It will further be appeciated from FIG. 4 that the side shell members 76, 78, top cover 88 and bottom cover 90 are profiled to be snap fitted together in known fashion and that the cable entry is cylindrical. FIG. 5 clearly shows how the housings 58 are secured by the side shell members.

Figure 6:
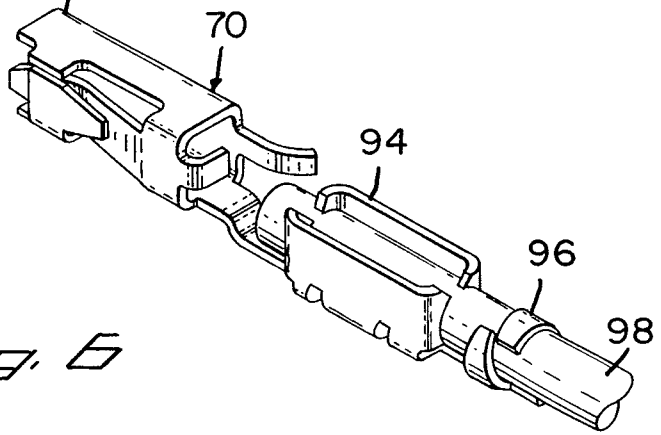
FIG. 6 is a perspective view of a representative terminal of the type used in the present invention.

A suitable terminal 70 is shown in FIG. 6. It is of the type shown in the above-mentioned U.S. Pat. No. 4,385,794, having a socket portion 92, an insulation piercing conductor engaging portion 94 and a strain relief crimp portion 96. FIG. 5 shows the terminals 70 in place in housing 58 terminating conductors 98 of shielded cable 100. The shielding layer 102 of the cable is clamped to the metal shell by crimp ring 104.

We claim:

1. A totally shielded backplane assembly for receiving at least one connector comprises:

a backplane having a plurality of pins extending from one surface thereof in at least one array, at least one shroud fixed against said one surface of said backplane, each shroud having sidewalls surrounding a respective pin array, said sidewalls forming a connector-receiving cavity having said pin array therein, a metal gasket mounted on each shroud, each gasket having means for providing electrical continuity between a shielded connector received in said cavity and a conductive chassis panel, a conductive chassis panel against said metal gasket, said panel having at least one aperture, each apertrue being aligned with a respective connector-receiving cavity, a cover assembly on said panel over each pin array, each said assembly having a series of removable sections, said sections being selectively removable to expose pin terminals as desired for engaging said at least one connector.

2. A shielded backplane assembly as in claim 1 wherein each removable section of said cover assembly has conductive contact means in contact with said gasket.

3. A shielded backplane assembly as in claim 1 wherein each said shroud further comprises a base disposed against said surface, said pin array passing through said base.

4. A shielded backplane assembly as in claim 1 further comprising retention means on said chassis panel, said retention means being effective to fix each said cover assembly to said panel and further to retain said at least one connector in each cavity.

5. A shielded backplane assembly as in claim 1 wherein said means for providing electrical continuity comprises a plurality of first tabs extending outward from said shroud and disposed against said chassis panel.

6. A shielded backplane assembly as in claim 1 wherein said means for providing electrical continuity comprises a plurality of second tabs depending into said cavity for engaging said connector.

* * * * *